US006308669B1

(12) United States Patent
Lancefield et al.

(10) Patent No.: US 6,308,669 B1
(45) Date of Patent: Oct. 30, 2001

(54) PHASE CHANGE COUPLING

(75) Inventors: Timothy Mark Lancefield, Bicester; Ian Methley, Witney, both of (GB)

(73) Assignee: Mechadyne PLC, Oxon (GB)

( * ) Notice: Subject to any disclaimer, the term of this patent is extended or adjusted under 35 U.S.C. 154(b) by 0 days.

(21) Appl. No.: 09/585,717

(22) Filed: May 31, 2000

(30) Foreign Application Priority Data

Jun. 1, 1999 (GB) ..... 9912597

(51) Int. Cl.[7] ..... F01L 1/34

(52) U.S. Cl. ..... 123/90.15; 123/90.15; 123/90.16; 123/90.17; 123/90.31; 464/1; 464/2; 464/160; 74/568 R

(58) Field of Search ..... 123/90.15, 90.16, 123/90.17, 90.31; 464/1, 2, 160; 74/568 R

(56) References Cited

U.S. PATENT DOCUMENTS 5,040,651 * 8/1991 Hampton ..... 192/45.1
5,117,784 * 6/1992 Schechter ..... 123/90.17
5,235,941 * 8/1993 Hampton ..... 123/90.17
5,870,983 * 2/1999 Sato ..... 123/90.17

* cited by examiner

*Primary Examiner*—Thomas Denion
*Assistant Examiner*—Jaime Corrigan
(74) *Attorney, Agent, or Firm*—Smith-Hill and Bedell

(57) ABSTRACT

A phase change coupling is disclosed for allowing the angular position of a drive member 10 of a camshaft 12 to be varied in relation to the camshaft. The coupling is additionally provided with a locking mechanism for preventing rotation of the drive member relative to the camshaft in only one direction during cranking of the engine, so that, during cranking of the engine, the drive member 10 is rotated in only one sense relative to the camshaft by the camshaft torque reversals until it reaches a predetermined start-up angular position.

8 Claims, 2 Drawing Sheets

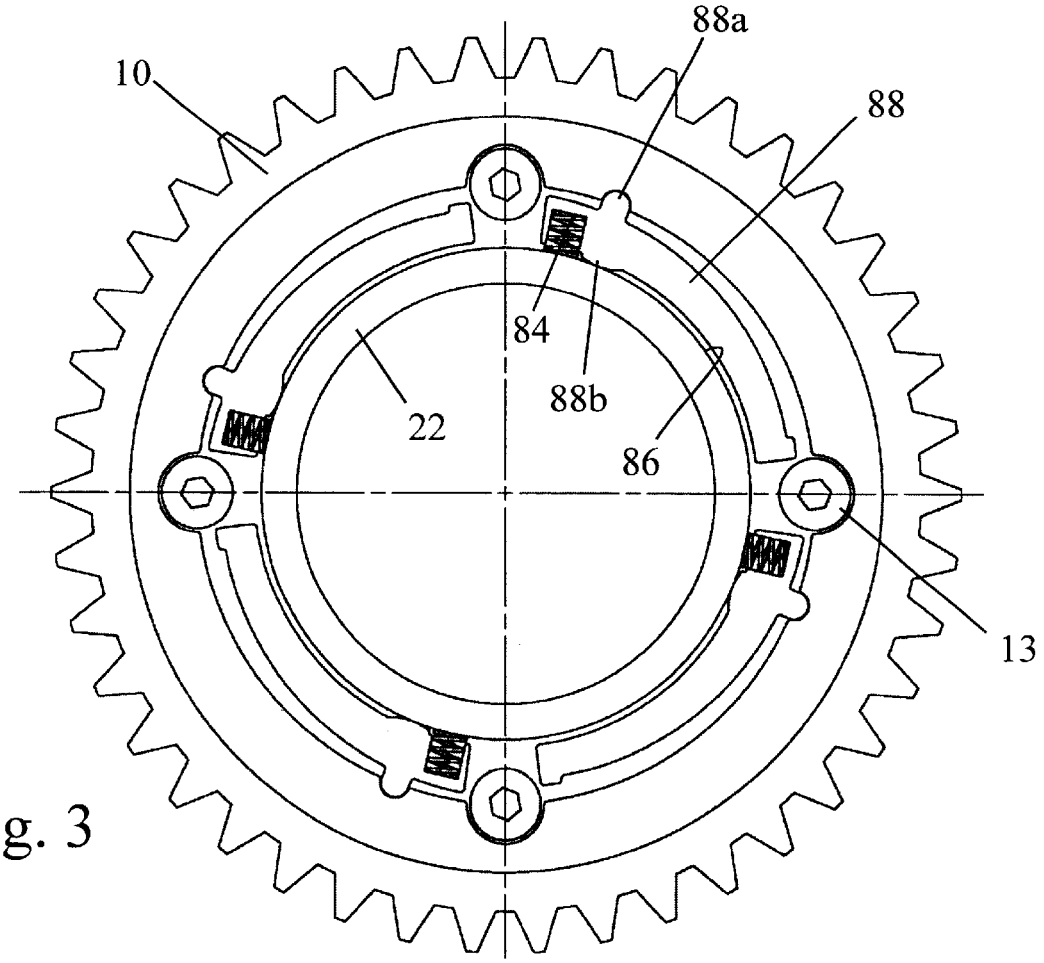
Fig. 3
Fig. 4
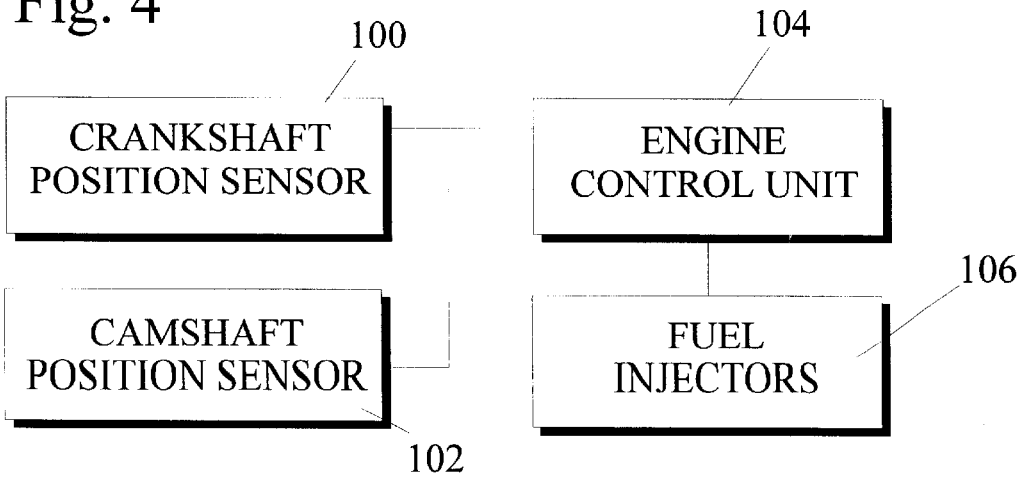

PHASE CHANGE COUPLING

FIELD OF THE INVENTION

The present invention relates to a phase change coupling for an engine camshaft.

BACKGROUND OF THE INVENTION

Phase change couplings are known for engine camshafts that allow the phase of intake and exhaust camshafts to be changed relative to one another or relative to the crankshaft in dependence upon the operating conditions of the engine. All such couplings require power to change the camshaft phase and this is derived directly or indirectly from the engine. In particular, if the phase change coupling is fluid pressure operated, the engine is required to run normally in order to provide the necessary fluid pressure.

Most of the camshaft phase change couplings currently in use have no means of locking the camshaft in a known angular position when there is insufficient actuation pressure to control the position of the phase change coupling.

The camshaft phasing couplings incorporating locking mechanisms that are known generally take the form of a locking pin that engages in a slot or hole when the phase change coupling is in its "start-up" position. In the case of an uncontrolled engine shut down, the phase change coupling may not be able to return to the start-up position and so the lock will not operate. With these existing types of phase change coupling, no amount of engine cranking will allow the phase change coupling to move to the correct position if there is insufficient control pressure because the cranking will always tend to retard the camshaft timing.

If the engine attempts to start while the phase change coupling is incorrectly positioned, poor emissions may result, or in the worst case the engine may not start at all. On account of recent emissions legislation, the risk of high pollutant levels upon engine start-up may not be tolerated.

SUMMARY OF THE INVENTION

With a view to mitigating the foregoing problems, the present invention provides a phase change coupling for an engine, comprising first means driven by an engine generated hydraulic pressure for varying the angular position of a drive member of the engine camshaft in relation to the camshaft, characterised by a locking mechanism that is operative only during cranking of the engine to lock the drive member mechanically to the camshaft in one direction of relative rotation and to permit the drive member and the camshaft to be rotated relative to one another in the opposite direction by the reaction torque of the camshaft on the drive member, whereby, when the engine generated hydraulic pressure is insufficient to drive the first means, the drive member and the camshaft are moved by the reaction torque of the camshaft towards a predetermined relative position suitable for starting the engine.

It is preferred to provide means for disabling the fuel supply to the engine until said predetermined relative position of the drive member and the camshaft is reached. Because the locking mechanism in the present invention will ensure that the camshaft will ultimately be driven into its correct phase for starting, one can afford to wait for the camshaft timing to be correct before any fuel is injected, thus avoiding any emissions concerns resulting from incorrect camshaft timing.

The invention may be applied to any fluid pressure operated phase change coupling, a suitable example being described in WO99/06675.

The locking mechanism may comprise a one-way clutch that is released when the fluid pressure used to actuate the phase change coupling reaches a sufficiently high level. Alternatively, the locking mechanism may comprise an electrically or centrifugally released clutch that only acts as a one-way clutch while the engine is being cranked below idling speed.

BRIEF DESCRIPTION OF THE DRAWINGS

The invention will now be described further, by way of example, with reference to the accompanying drawings, in which:

FIG. 3 is a section generally similar to that of FIG. 2 showing an alternative construction of the locking mechanism, and FIG. 4 is a block schematic diagram showing the disablement of the fuel supply to the engine.

DETAILED DESCRIPTION OF THE PREFERRED EMBODIMENTS

Figure 1:
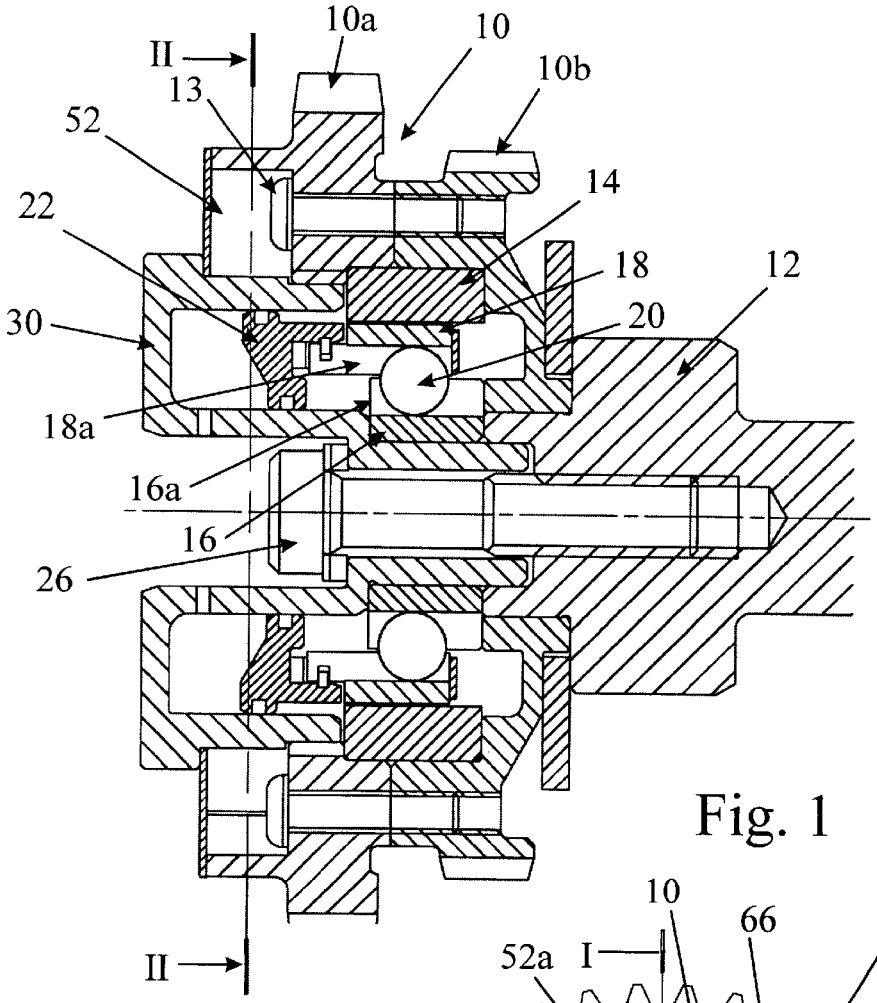
FIG. 1 is a section through a phase change coupling of the invention, the section being taken along the line I—I in FIG. 2.

FIG. 1 is a section through a hydraulically operated phase change coupling that is of the type described in WO99/06675, being essentially the same as the embodiment illustrated in FIG. 7 of the latter international patent application. A brief description of the phase change coupling is given below and more details of this coupling are set out in the latter publication.

The phase change coupling in FIG. 1 is arranged to transmit rotation from a drive member 10 to a camshaft 12. The drive member 10 is a toothed sprocket having two sets of teeth 10*a* and 10*b*.The teeth 10*a* are engaged by a drive chain driven by the crankshaft whilst the teeth 10*b* are part of a gear drive for auxiliary engine components not shown in the drawing.

The mechanism for connecting the drive member 10 for rotation with the camshaft 12 is formed of an outer race 14 that is fast in rotation with the drive member 10, an inner race 16 that is fast in rotation with the camshaft 12, an intermediate member 18 and two sets of balls 20.

The drive member 10 is formed in two parts and the outer race 14 is clamped between them by means of screws 13. The inner race on the other hand is clamped by means of a central bolt 26 between an annular cylinder 30 and the camshaft 12. The intermediate member 18 is axially displaceable relative to the inner race 16 and the outer race 14 by means of an annular hydraulic piston 22 received in the annular cylinder 30.

The inner race 16 is formed with helical grooves 16*a* on its outer surface while the intermediate member 18 is formed with helical grooves 18*a* on its inner surface. A set of balls trapped between the two sets of helical grooves couples the intermediate medium 18 for rotation with the inner race 16 in all positions of the piston 22. Axial 30 displacement of the intermediate member 18 causes it to rotate relative to the inner race 16 on account of the pitch of the helical grooves 16*a* and 18a.

The intermediate member is coupled in the same way to 35 the outer race 14 by means of helical grooves on the inner surface of the outer race 14, helical grooves on the outer surface of the intermediate member 18 and a second set of balls. These balls and grooves are not seen in FIG. 1 as they do not intersect the section plane of the drawing but they are entirely analogous to the illustrated coupling between the inner race 16 and the intermediate member 18. However, the helical grooves coupling the intermediate member 18 to the outer race 14 have a different pitch from the grooves coupling the intermediate member 18 and the inner race 16, with the result that axial displacement of the intermediate member 18 results in a rotation of the drive pulley 10 relative to the camshaft 10, bringing about the desired change of phase.

The above described phase change coupling is just one example of a mechanism that is hydraulically actuated to s15 bring about a change of phase of a camshaft and it should be made clear that the invention is equally applicable to any phase change mechanism that is actuated by an engine generated fluid pressure.

The invention resides in the provision of a locking mechanism that prevents rotation of the drive member 10 relative to the camshaft 12 in one direction while the engine is being cranked at low speed.

Figure 2:
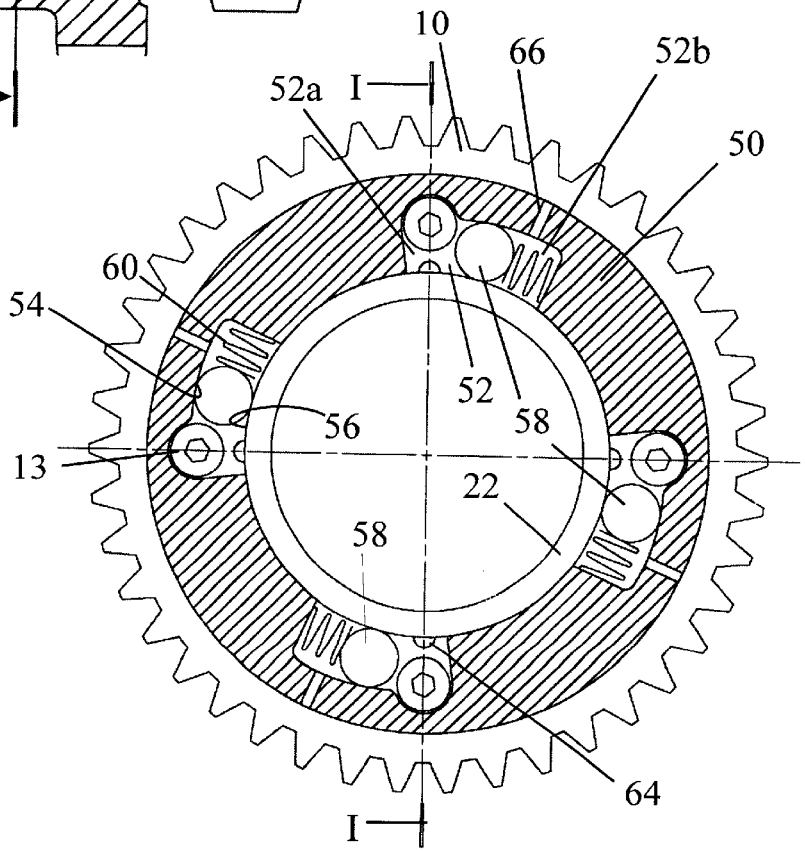
FIG. 2 is a section through the phase change coupling of FIG. 1, taken along the section line II—II in FIG. 1.

In the embodiment shown in FIG. 2, the locking mechanism is a hydraulically released one-way clutch. An annular collar 50 projecting from the front face of the drive member 10 is formed with four recesses 52 each having a ramp surface 54. The collar 50 surrounds the outer surface of the annular cylinder 30 and the latter defines an inner race surface 56 of the hydraulically releasable one-way clutch. Cylindrical rollers 58 are biased by springs 60 into a position in which they are wedged between the ramp surfaces 54 and the inner race surface 56. The rollers also divide each recess 52 into a first chamber 52*a* connected by a passage 64 to the high pressure side of the hydraulic pump and a second chamber 52*b* having a vent opening 66 through which oil can escape from the recess 52 to return to the low pressure side of the hydraulic pump.

In operation, in the absence of a sufficiently high hydraulic pressure to compress the springs 60, the rollers 58 are wedged between the ramp surfaces 54 and the race surface 56. In this position, the lock mechanism acts as a one-way clutch permitting the inner race 56 to rotate clockwise (as viewed in FIG. 2) but not anticlockwise. When the hydraulic pressure is sufficiently high to compress the springs 60, on the other hand, the rollers 58 are pushed away from the ramp surfaces 54 allowing relative rotation of the drive member 10 relative to the race surface 56 in both directions.

During cranking, the torque reaction from the camshaft will periodically reverse in direction. When the torque reaction acts to rotate the inner race 56 anticlockwise relative to the drive member, the torque will be resisted by the one-way clutch action of the rollers 58. On the other hand, when the torque reaction acts in the opposite direction the inner race will rotate clockwise with the camshaft towards its start-up position. After several cycles, the camshaft will have reached its start-up position.

As seen in FIG. 4, the engine control unit (ECU) 104 is connected to a crankshaft position sensor 100 and a camshaft position sensor 102 will from these can determine when the camshaft has reached its start-up position. During start-up, the control unit 104 acts on fuel injectors 106 to maintain them closed until this desired start-up position is reached. As fuelling is suppressed during initial cranking, there will be no undesired exhaust emissions from the engine on account of incorrect valve timing nor on account of the engine refusing to start.

As soon as the engine fires and reaches idling speed, the hydraulic pressure builds up and releases the rollers 58, so that the locking mechanism plays no further part in the setting of the valve timing.

The embodiment of FIG. 3 uses a one-way clutch action that is released by speed rather than hydraulic pressure. Four sprags 88 are arranged around the inner race surface 86 and are captive between the inner race surface 86 and the inner surface of a collar 80 that projects from the front face of the drive member 10. Each sprag has a fulcrum 88*a* that sits within a recess in the collar 80 and a cam surface 88*b* on its opposite side facing the inner race surface 86. Each sprag 88 has a short side acted upon by a spring 84 and a long side that acts as a centrifugal weight and flies out against the action of the spring 84 when the lock mechanism is rotating at a speed in excess of the engine idling speed.

In operation, at low cranking speeds, each sprag is rotated by its spring 84 clockwise as viewed. In this position, the cam 88*b* is shaped to act as a wedge to prevent the inner race 86 from rotating anticlockwise (as viewed in FIG. 3) relative to the drive member 10. On the other hand, the cam 88*b* is released from its wedging position when the inner race surface 86 rotates clockwise relative to the drive member 10. Once again, the locking mechanism therefore behaves as a one-way clutch that acts in conjunction with the torque reversals to advance the camshaft to its start-up position. After a few turns of the engine, the correct valve timing is achieved and the engine is fired. Once the engine reaches idling speed, the sprags are rotated anticlockwise as viewed by the centripetal force acting on them to compress the springs 84 and release the one-way clutch mechanism. Thereafter the locking mechanism plays no further part in the operation of the phase change coupling.

It will be appreciated that various modifications may be made to the described embodiments without departing from the scope of the invention as set out in the appended claims. For example, it would be possible to design a coupling in which the one-way clutch is electrically actuated. The one-way clutch may for example comprise sprags as shown in FIG. 3 that are moved to a disengaged position by means of a stationary electromagnet. As a further alternative, an electrically operated one-way clutch may comprise a cage that contacts all the rollers and an electromagnet may act to rotate the cage to urge the rollers away from their ramp surfaces against the action of their springs. Furthermore, a fluid pressure actuated one-way clutch may constructed that uses sprags rather than rollers.

What is claimed is:

1. A phase change coupling for an engine, comprising first means driven by an engine generated hydraulic pressure for varying the angular position of a drive member of the engine camshaft in relation to the camshaft, characterised by a locking mechanism that is operative only during cranking of the engine to lock the drive member mechanically to the camshaft in one direction of relative rotation and to permit the drive member and the camshaft to be rotated relative to one another steplessly in the opposite direction by the reaction torque of the camshaft on the drive member, whereby, when the engine generated hydraulic pressure is insufficient to drive the first means, the drive member and the camshaft are moved by the reaction torque of the camshaft towards a predetermined relative position suitable for starting the engine, forces acting directly on the locking elements serving to release the locking mechanism when sufficient hydraulic pressure is generated by the engine to drive the first means.

2. A phase change coupling as set forth in claim 1, wherein the locking mechanism comprises a rolling element arranged between a cylindrical race on one of the drive member and the camshaft and a ramp surface on the other and biased by a spring towards the ramp surface, the rolling element being urged away from the ramp surface against the action of the spring when the hydraulic fluid pressure generated by the engine and acting directly on the rolling elements reaches a sufficiently high value to drive the said first means.

3. A phase change coupling as set forth in claim 1, wherein the locking mechanism is a centrifugally released one-way clutch that only locks the camshaft to the drive member while the engine is being cranked at a speed below idling speed.

4. A phase change mechanism as set forth in claim 1, wherein the locking mechanism comprises an electrically actuated one-way clutch that only locks the camshaft to the drive member while the engine is being cranked at a speed below idling speed.

5. In an internal combustion engine having a camshaft and a phase change coupling comprising first means driven by an engine generated hydraulic pressure for varying the angular position of a drive member of the camshaft relative to the camshaft, a locking mechanism that is operative only during cranking of the engine to lock the drive member mechanically to the camshaft in one direction of relative rotation and to permit the drive member and the camshaft to be rotated relative to one another steplessly in the opposite direction by the reaction torque of the camshaft on the drive member, whereby, when the engine generated hydraulic pressure is insufficient to drive the first means, the drive member and the camshaft are moved by the reaction torque of the camshaft towards a predetermined relative position suitable for starting the engine, forces acting directly on the locking elements serving to release the locking mechanism when sufficient hydraulic pressure is generated by the engine to drive the first means, the engine further comprising means for disabling the fuel supply to the engine until said predetermined relative position of the drive member and the camshaft is reached.

6. An engine as set forth in claim 5, wherein the locking mechanism comprises a rolling element arranged between a cylindrical race on one of the drive member and the camshaft and a ramp surface on the other and biased by a spring towards the ramp surface, the rolling element being urged away from the ramp surface against the action of the spring when the hydraulic fluid pressure generated by the engine and acting directly on the rolling elements reaches a sufficiently high value to drive the said first means.

7. An engine as set forth in claim 5, wherein the locking mechanism is a centrifugally released one-way clutch that only locks the camshaft to the drive member while the engine is being cranked at a speed below idling speed.

8. An engine as set forth in claim 5, wherein the locking mechanism comprises an electrically actuated one-way clutch that only locks the camshaft to the drive member while the engine is being cranked at a speed below idling speed.

* * * * *